United States Patent [19]

Rubio

[11] 3,970,181

[45] July 20, 1976

[54] TWO-COIN-OPERATED DISPENSING MECHANISM

[75] Inventor: Alfred M. Rubio, Chicago, Ill.

[73] Assignee: National Sanitary Laboratories, Inc., Chiago, Ill.

[22] Filed: Aug. 11, 1975

[21] Appl. No.: 603,516

[52] U.S. Cl. ..... 194/63

[51] Int. Cl.[2] ..... G07F 5/04

[58] Field of Search..... 194/63, 1 G, DIG. 2, 194/61, 62, 64–66, 9 T

[56] References Cited

UNITED STATES PATENTS

| | | | |
|---|---|---|---|
| 1,901,529 | 3/1933 | Olsen | 194/DIG. 2 |
| 3,756,366 | 9/1973 | Greenwald | 194/9 T |

*Primary Examiner*—Stanley H. Tollberg

*Attorney, Agent, or Firm*—Prangley, Dithmar, Vogel, Sandler & Stotland

[57] ABSTRACT

Conversion mechanism is disclosed for converting a coin-operated dispensing apparatus including an actuating means and a coin-receiving wheel coupled thereto for movement thereof in response to receipt of a single coin, to a mode of operation only in response to receipt of two coins. The conversion mechanism includes a drive plate coupled to the coin-receiving wheel for rotation therewith and carrying a pivotable drive pawl normally biased toward driving engagement with a modified actuating member, and a cam member for moving the pawl out of driving engagement with the actuating member upon rotation of the coin-receiving wheel in response to a first coin, the pawl moving back into driving engagement with the actuating member upon rotation of the coin-receiving wheel in response to insertion of a second coin.

15 Claims, 7 Drawing Figures

TWO-COIN-OPERATED DISPENSING MECHANISM

BACKGROUND OF THE INVENTION

This invention relates to coin-operated dispensing apparatus such as vending machines, which are normally enabled for dispensing operation by insertion of a single coin of predetermined denomination. Such dispensing apparatus for vending packaged materials, for example, are well known in the art and typically include a dispensing member for engaging and dispensing the merchandise package, an actuating member for movement into engagement with and actuation of the dispensing member, and a coin-receiving wheel rotatable upon insertion of a coin therein for moving the actuating member and for transporting the coin to a coin discharge station.

As a result of rapid price inflation, the cost of much merchandise sold from vending machines has risen rapidly, sometimes doubling in the space of a year or two. Accordingly, it is necessary to either replace the vending machines in use with machines adapted for vending upon insertion of coins having a higher value, or alternatively, to modify existing machines to change the number or denomination of coins in response to which the machine will operate. Either alternative has, in the past, been quite expensive and time-consuming. For example, modification of existing machines has necessitated returning the machines to a factory or shop for extensive alterations to the coin-controlled mechanism. Often, entirely new mechanisms must be installed at considerable expense.

SUMMARY OF THE INVENTION

Accordingly, the present invention provides a unique conversion mechanism for use in combination with a standard single-coin dispensing apparatus in order to render the apparatus operable for dispensing only upon the insertion of two coins of a predetermined denomination.

In addition, the present invention provides a simple and inexpensive mechanism which can be readily attached to an existing dispensing mechanism with little effort, and which affords a unique two-coin mode of dispensing operation.

It is a general object of the present invention to provide coin-controlled apparatus comprising coin-enabled means operative upon receipt of a coin therein for undergoing a predetermined movement, actuating means movable for performing a predetermined function, and clutch mechanism coupled to the coin-enabled means and movable between an engaged condition coupling the actuating means to the coin-enabled means for movement therewith and a disengaged condition decoupling the actuating means from the coin-enabled means, operation of the coin-enabled means upon receipt of a first coin therein effecting movement of the clutch mechanism to the disengaged condition thereof so that the actuating means is not moved with the coin-enabled means, further operation of the coin-enabled means upon receipt of a second coin therein effecting movement of the clutch mechanism to the engaged condition thereof for moving the actuating means with the coin-enabled means to perform the predetermined function, whereby the predetermined function is performed only after two coins are received in the apparatus.

Another object of this invention is to provide in a coin-controlled dispensing mechanism having a dispensing member for dispensing merchandise only upon insertion of two coins, the combination comprising a housing having a coin-receiving slot therein, a coin-receiving wheel mounted for rotation on the housing, a handle connected to the coin-receiving wheel for effecting rotation thereof, means for preventing rotation of the coin-receiving wheel in the absence of a coin therein, an actuating member mounted on the housing and movable for engagement with and actuation of the associated dispensing member, drive means coupled to the coin-receiving wheel for rotation therewith and disposed for driving engagement with the actuating member, bias means urging the drive means toward driving engagement with the actuating member, and a cam member disposed in the path of the drive means for camming engagement therewith to move the drive means out of driving engagement with the actuating member, rotation of the coin-receiving wheel upon receipt of a first coin therein effecting movement of the drive means into camming engagement with the cam member to move the drive means out of driving engagement with the actuating member so that the actuating member is not driven in response to rotation of the coin-receiving wheel, further rotation of the coin-receiving wheel upon receipt of a second coin therein effecting movement of the drive means into driving engagement with the actuating member for driving thereof by the coin-receiving wheel into engagement with the associated dispensing member for actuating same, whereby actuation of the associated dispensing member is effected only upon the receipt of two coins in the coin-receiving wheel.

In connection with the foregoing object, still another object of this invention is to provide a combination of the type set forth, wherein the coin-receiving wheel has two diametrically spaced-apart coin receptacles thereon, the actuating member having two equiangularly spaced-apart drive surfaces thereon, the drive means being disposed for engagement with the drive surfaces.

It is another object of this invention to provide a conversion mechanism including a drive plate and modified actuating member, adapted to be substituted for the actuating member of a single-coin dispenser in order to convert it to a two-coin operation.

Further features of the invention pertain to the particular arrangement of the parts of the conversion mechanism and the resulting dispensing apparatus whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
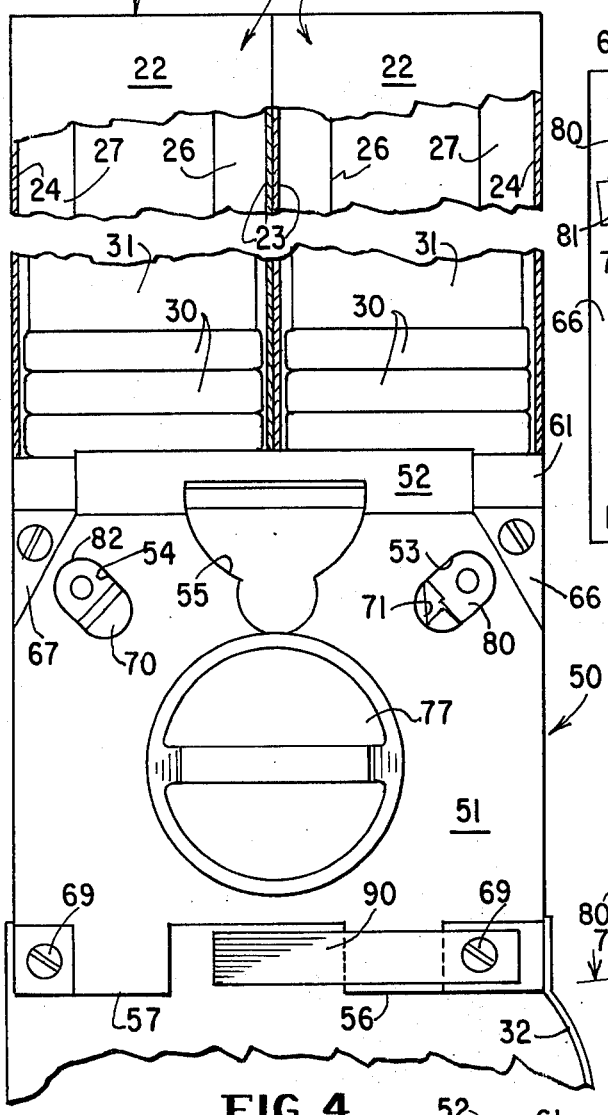
FIG. 1 is a front elevational view in partial vertical section of a vending machine including a dispensing mechanism constructed in accordance with and embodying the features of the present invention, with portions of the vending machine broken away.
Figures 2, 3:
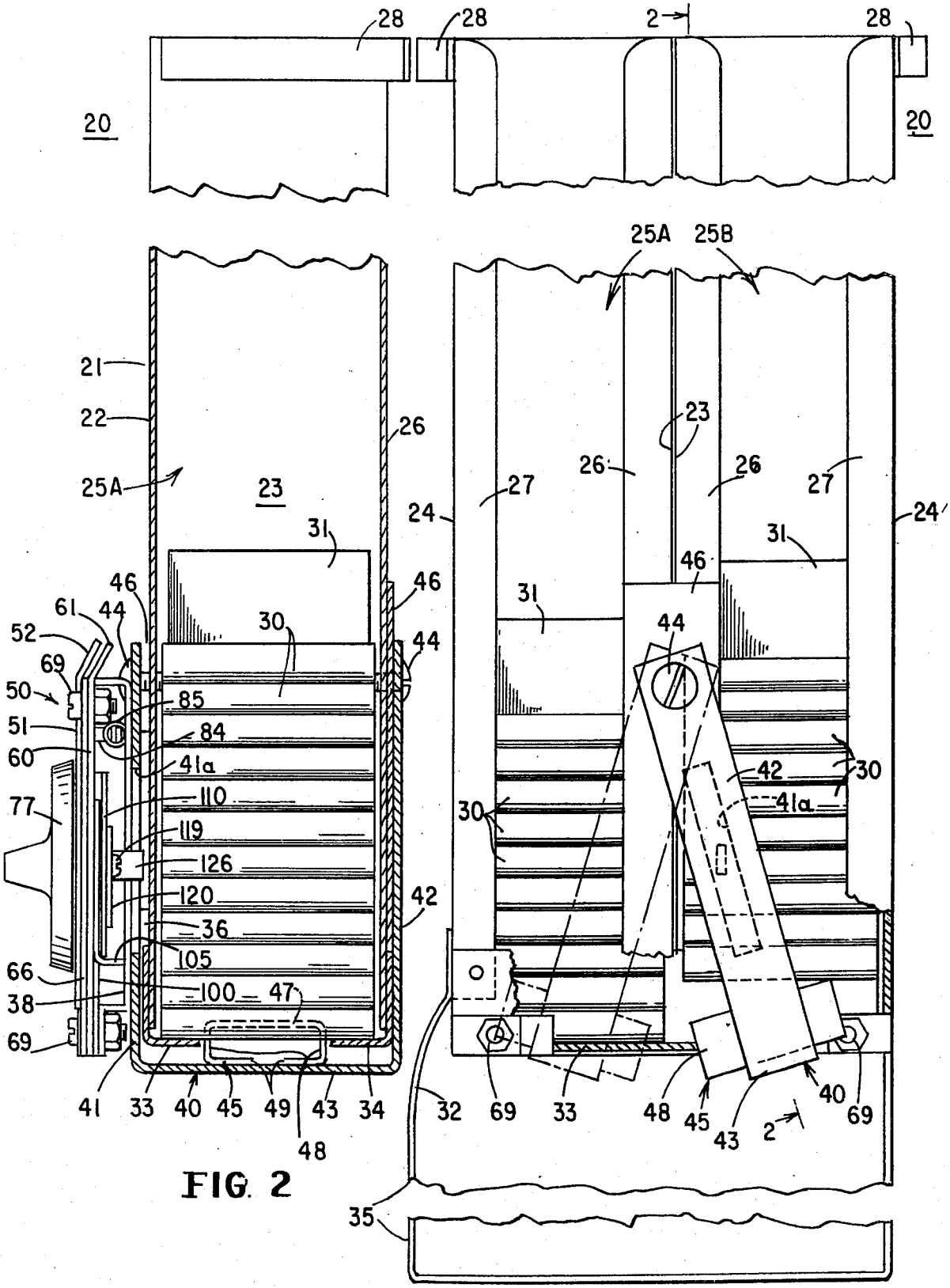
FIG. 2 is a side elevational view in partial vertical section of the vending machine of FIG. 1, as viewed from the right-hand side thereof.
FIG. 3 is a rear elevational view in partial vertical section of the vending machine of FIG. 1.

Referring now to FIGS. 1 through 3 of the drawings, there is illustrated a vending machine, generally designated by the numeral 20, including an elongated housing 21 oriented substantially vertically in use, and including two merchandise magazines 25A and 25B, arranged in side-by-side relationship. The magazines 25A and 25B are substantially identical in construction, each including a rectangular front wall 22 and a pair of opposed side walls 23 and 24, respectively terminating at the rearward edges thereof in inturned rear flanges 26 and 27 arranged parallel to the front wall 22. The innermost side walls 23 of the magazines 25A and 25B are disposed side by side and are preferably fixedly secured together as by welding. Attached to the outer side walls 24 of each of the magazines 25A and 25B is a mounting bracket 28 for mounting the vending machine 20 on a wall or other support surface.

Fixedly secured respectively to the front wall 22 and the rear flanges 26 and 27 of the magazines 25 at the bottom thereof are front and rear retaining arms 33 and 34, which extend beneath the magazines 25 toward each other to form a floor for the magazines 25, the inner edges of the retaining arms 33 and 34 being spaced apart a predetermined distance. Each of the magazines 25 accomodates therein a stack of packages 30 of merchandise to be dispensed from the vending machine 20, the space between the rear flanges 26 and 27 of each of the magazines 25 facilitating insertion of the packages 30 into the magazines. Preferably a weight 31 is disposed atop each of the stacks of packages 30 to insure that the bottommost package will be in contact with the retaining arms 33 and 34. While packages 30 of merchandise have been described, it will, of course, be understood that the vending machine 20 could also be utilized for the vending of bulk materials. A skirt flange 32 may be attached to one or both of the magazines 25 at the lower end thereof and extending downwardly therebeneath to guide the packages 30 as they are dispensed from the magazines 25. A coin box 35 is preferably also disposed beneath the magazines 25 for receiving coins inserted into the vending machine 20, in a well-known manner. A band or strip 36 of spring steel is secured to the front walls 22 immediately above the upper edge of the front retaining arm 33, the strip 36 being formed generally in the shape of a very shallow "V" with the apex extending forwardly for a purpose to be explained more fully below. Preferably, there is also mounted on the front walls 22 a pair of mounting brackets 38 for supporting thereon the dispensing mechanism of the vending machine 20, in a manner to be described more fully hereinafter.

A dispensing bail, generally designated by the numeral 40, is carried by the vending machine 20, the bail 40 including a front arm 41 and a rear arm 42 interconnected at the lower ends thereby by a bight portion 43. The front arm 41 of the dispensing bail 40 has an elongated rectangular slot 41*a* formed therein, for a purpose to be described more fully hereinafter, and the arm 41 is disposed for engagement with the spring strip 36. The upper ends of the front and rear arms 41 and 42 are respectively pivotally mounted by screws 44 on mounting plates 46 respectively attached to the front wall 22 and the rear flanges 26, with the bight portion 43 extending beneath the bottom retaining arms 33 and 34. Fixedly attached as by welding to the bight portion 43 centrally of the upper surface thereof is a generally channel-shaped dispensing foot 45 having a top wall 47, a pair of opposed side walls 48 and a pair of inturned attachment flanges 49. The dispensing foot 45 is dimensioned and positioned to be disposed in use in the gap between the bottom retaining arms 33 and 34 and to extend a predetermined distance thereabove so as to be engageable with the bottommost package 30 in each of the magazines 25A and 25B.

In use, the dispensing bail 40 moves between the positions illustrated in solid line and in broken line in FIG. 3, against the resistance of the spring strip 36. More particularly, if the mechanism starts out in the position illustrated in solid line in FIG. 3, the dispensing bail 40 moves to the position illustrated in broken line during a dispensing operation, and in so doing engages the bottommost package 30 in the magazine 25A along the right-hand edge thereof, as viewed in FIG. 3, and ejects it from the open left-hand side of the magazine 25A. As the dispensing bail 40 continues its dispensing movement, it engages the next package 30 above the one dispensed and lifts the entire stack slightly as the bail 40 comes to rest in the broken line position in FIG. 3. At the same time, the stack of packages 30 in the magazine 25B drops, so that the bottommost package 30 rests upon the bottom retaining arms 33 and 34 in a position for being dispensed from the open right-hand side of the magazine 25B, as viewed in FIG. 3, during the next dispensing operation.

A coin-operated dispensing mechanism, generally designated by the numeral 50, for operating the dispensing bail 40 is mounted by mounting screws 69 upon the mounting brackets 38 at the front of the vending machine 20 adjacent to the bottom thereof. Referring now also FIGS. 4 through 7 of the drawings, the dispensing mechanism 50 includes a generally rectangular front cover plate 51 provided with an inturned top flange 52 and having a pair of service openings 53 and 54 respectively disposed adjacent to the upper corners thereof. Formed in the cover plate 51 between the service openings 53 and 54 is a coin slot 55 for receiving a coin of a predetermined denomination. Extending downwardly from the bottom edge of the cover plate 51 are two spaced-apart depending lugs 56 and 57. Fixedly secured as by welding to the rear surface of the cover plate 51 adjacent to the opposite side edges thereof are two spacer strips 66 and 67 (FIG. 6), each having a generally arcuate inner edge, which edges define arcs of a common circle.

Secured to the spacer strips 66 and 67 by the mounting screws 69 is a generally rectangular rear plate 60 which is generally coextensive with the cover plate 51, and is provided at the upper edge thereof with an inturned top flange 61. Service openings 63 and 64 are provided in the rear plate 60 in registry with the service openings 53 and 54 in the cover plate 51. Formed substantially centrally of the bottom edge of the rear plate 60 is a coin recess 65 to facilitate discharge of a coin into the coin box 35, as will be described more fully below.

Figure 5:
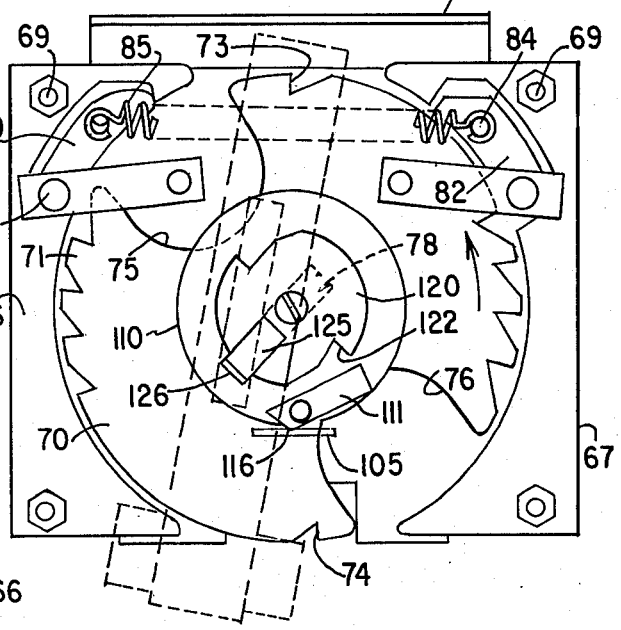
FIG. 5 is a view similar to FIG. 4, but with the cam place and rear plate removed to show the coin-receiving wheel and associated pawls and dogs, and with the parts arranged in their positions partway through a revolution in response to a first coin.

The spacer strips 66 and 67 serve to separate the cover plate 51 and the rear plate 60 and cooperate therewith to define a generally circular cavity therebetween, in which is disposed a generally disc-like coin wheel 70. Formed in the coin wheel 70 are two diametrically spaced-apart perimetrical coin-receiving receptacles 75 and 76, each dimensioned to receive a coin of a predetermined denomination. Also formed in the edge of the coin wheel 70 and respectively extending in a counterclockwise direction from the coin receptacles 75 and 76, as viewed in FIG. 5, are two sets of ratchet teeth 71. Formed in the edge of the coin wheel 70 a slight distance clockwise from the coin receptacles 75 and 76 are two detents 73 and 74. A handle or knob 77 is disposed forwardly of the cover plate 51 centrally thereof and is provided with a generally rectangular shaft or hub portion 78 which extends through coaxial circular openings in the cover plate 51 and the rear plate 60 and a complementary rectangular opening in the coin wheel 70, in order to effect manual rotation of the coin wheel 70 with respect to the cover plate 51 and rear plate 60.

Figure 7:
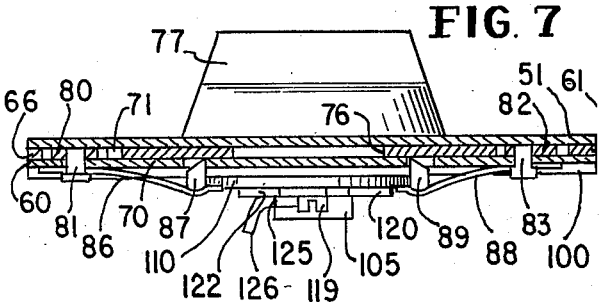
FIG. 7 is a view generally in horizontal section, taken along the line 7—7 in FIG. 6.

Disposed between the front plate 51 and the rear plate 60, respectively in complementary recesses in the spacer strips 66 and 67, are a coin dog or pawl 80 and an antibackup dog or pawl 82. The pawls 80 and 82 are respectively mounted adjacent to the lower ends thereof for pivotal movement on pivot pins 81 and 83 which extend through complementary openings in the rear wall 60. Respectively carried by the pawls 80 and 82 adjacent to the other ends thereof are lugs 84 which project rearwardly through the service openings 63 and 64 and the rear plate 60 and are interconnected by a tension spring 85 which serves to urge the pawls 80 and 82 toward each other and into engagement with the peripheral edge surface of the coin wheel 70. Two spring steel bands 86 and 88 are disposed rearwardly of the rear wall 60 respectively below the access openings 63 and 64, and are respectively fixedly secured to the pins 81 and 83. Carried by band 86 adjacent to the distal end thereof is a forward washer dog 87, while the band 88 carries adjacent to the distal end thereof a reverse washer dog 89, the dogs 87 and 89 each having beveled surfaces and respectively extending through complementary openings in the rear wall 60 (FIG. 7). The dogs 87 and 89 are respectively urged by the spring steel bands 86 and 88 into engagement with the rear surface of the coin wheel 70 along an imaginary circular line which passes approximately through the centers of the coin receptacles 75 and 76. Preferably, there is also provided a spring steel retaining tab 90 which is fixedly secured to the spacer strip 66 and the bottom thereof by one of the mounting screws 69, the tab 90 extending over the lug 56 and into the space between the lugs 56 and 57 and rearwardly of the cover plate 51. Thus, the coin wheel 70 and the associated pawls 80 and 82 and the dogs 87 and 89 constitute a coin-enabled means which is enabled by insertion of a coin of predetermined denomination to permit rotation of the coin wheel 70.

All of the apparatus described hereinabove is conventional and is well-known in the prior art. Conventionally, the coin wheel 70 is connected to a member which extends into the slot **41*a* in the front arm 41 of the dispensing bail 40, so that when the coin wheel 70 is rotated through a half revolution in the counterclockwise direction, as viewed in FIGS. 5 and 6, the dispensing bail 40 will be moved, for example, from the solid line position to the broken line position illustrated in FIG. 3 to dispense a package 30. On the next half revolution of the dispensing wheel 70, the dispensing bail 40 would be moved back to the solid line position of FIG. 3, to dispense another one of the packages 30. In this conventional operation, the coin wheel 70 would be enabled to undergo a half revolution upon the insertion of a single coin of predetermined denomination in the coin receptacle positioned at the top of the dispensing mechanism 50 adjacent to the coin slot 55. Thus enabled, the coin wheel 70 is manually rotated through a half revolution by means of the knob 77, which half revolution carries the coin to the bottom of the dispensing mechanism 50 where it is urged by the retaining spring 90 through the coin recess 65 in the rear plate 60 and thence into the coin box 35. This half revolution of the coin wheel 70 brings the other one of the coin receptacles 75 and 76** into position for receiving another coin for the next dispensing operation.

Figure 6:
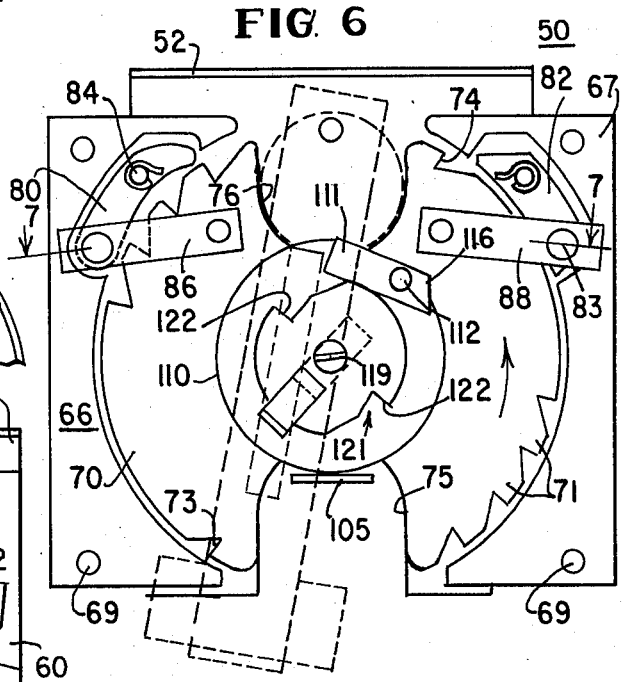
FIG. 6 is a view similar to FIG. 5, but with the parts arranged in their position at the end of the first revolution, with the coin-receiving wheel in a position to receive a second coin.

The pawls 80 and 82 and the dogs 87 and 89 act to prevent rotation of the coin wheel 70 in the absence of a coin of predetermined denomination in one of the coin receptacles 75 or 76. Referring, for example, to FIGS. 6 and 7, if one attempts to move the coin wheel 70 in a forward dispensing direction (counterclockwise), the coin pawl 80 will fall into the coin receptacle 76 under the urging of the tension spring 85 and bear against the right-hand wall of the coin receptacle 76 to prevent further rotation of the coin wheel 70 in that direction. A similar blockage will result if one attempts to operate the mechanism by placing in the coin receptacle a coin smaller in diameter than the one of the predetermined denomination. Retrograde rotation (clockwise) of the coin wheel 70 is prevented by engagement of the antibackup pawl 82 in the detent 74 (or 73). Should the detent 74 be effectively blocked or covered over, retrograde rotation would be prevented by the pawl 82 falling into the coin receptacle 76 and engaging a left-hand wall thereof. Retrograde rotation of the coin wheel 70 is further prevented by the ratchet teeth 71 which will engage the pawl 82, should the coin receptacles 75 or 76 somehow be rotated backwards past the pawl 82.

The washer dogs 87 and 89 prevent operation of the dispensing mechanism 50 by insertion in the coin receptacles 75 or 76 of a washer of approximately the same diameter as the predetermined coin. While a washer will prevent the coin dog 80 from blocking rotation of the coin wheel 70 in a dispensing direction, in the same manner as such blockage would be prevented by the presence of the predetermined coin in the coin receptacle, as the washer passes the dog 87, the dog 87 will be urged into the hole in the washer and engage the inner edge thereof to prevent further rotation of the coin wheel 70. In like manner, the dog 89 will prevent retrograde rotation of the coin wheel 70 by the use of a washer.

It is a significant feature of the present invention that this conventional dispensing apparatus is modified so as to be operable to perform a dispensing operation only upon the insertion in the dispensing mechanism 50 of two coins of the predetermined denomination. To this end, there is provided a cam plate 100 (FIG. 4) which is fixedly secured to the rear surface of the rear plate 60 by means of the bottom two mounting screws 69, the cam plate 100 having an upper edge 101 which is disposed beneath the spring steel bands 86 and 88. The cam plate 100 is provided with a circular opening (not shown) therethrough to accommodate the hub or shaft 78 of the knob 77, and is also provided centrally of the lower edge thereof with a rectangular coin recess 103 to permit discharge of a coin into the coin box 35. Integral with the cam plate 100 centrally of the upper edge of the coin recess 103 and extending rearwardly therefrom is a cam flange 105.

Mounted on the handle shaft 78 coaxially therewith and rearwardly of the cam plate 100 is a circular drive plate or disc 110 carrying on the rear surface thereof a drive pawl 111 which is pivotally mounted adjacent to one end thereof by a pivot pin 112 secured to the drive plate 110 adjacent to the periphery thereof. That one end of the drive pawl 111 is provided with a camming surface 116 which extends a slight distance radially outwardly beyond the edge of the drive plate 110. The drive pawl 111 is urged into counterclockwise rotation about the pivot pin 111 (as viewed in FIG. 4) by a retaining leaf spring 115 which is wrapped around the pivot pin 111 and has one end thereof anchored adjacent to the distal end of the drive pawl 111 and the other end thereof anchored to the drive plate 110.

Overlying the rear surface of the drive plate 110 is a generally circular actuator plate or disc 120 which is disposed substantially coaxially with the handle shaft 78. Preferably, the handle shaft 78 is provided at the rear end thereof with a small cylindrical projection (not shown) which extends through a complementary opening in the actuator plate 120 to accommodate free rotation of the actuator plate 120 with respect to the drive plate 110. A mounting screw 119 is threadedly engaged with the projection in the handle shaft 78 for holding the drive plate 110 and the actuator plate 120 in their assembled condition. Formed in the edge of the actuator plate 120 are two diametrically spaced-apart detents or recesses 121, each having a generally radially extending drive surface 122. Fixedly secured to the rear surface of the actuator plate 120 as by welding is an actuator member 125 having a rearwardly extending finger 126 disposed for engagement in the slot 41*a* of the front arm 41 of the dispensing bail 40.

The operation of the dispensing mechanism 50 will now be described. When the mechanism is in its ready position, illustrated in FIG. 4, the coin receptacle 75 will be disposed upwardly adjacent to the coin slot 55. The drive pawl 111 is disposed in one of the detents 121 in the actuator plate 120, in engagement with the corresponding drive surface 122. When, after insertion of a coin of predetermined denomination in the coin receptacle 75, the coin wheel 70 is rotated through about one-sixth of a revolution in the dispensing direction, to the position illustrated in FIG. 5, the camming surface 116 on the drive pawl 111 is carried into camming engagement with the cam flange 105, thereby pivoting the drive pawl 111 in a clockwise direction, as viewed in FIG. 5, out of engagement with the actuator plate 120, against the urging of the retaining spring 115. As the rotation of the coin wheel 70 continues, the rotation of the drive plate 110 and the drive pawl 111 continues with it, but the actuator plate 120 remains stationary in the position illustrated in FIG. 5. As the drive pawl 111 is carried past and out of engagement with the cam flange 105, the cam pawl 111 is pivoted counterclockwise under the urging of the retaining spring 115 back into engagement with the outer periphery of the actuator plate 120, beyond the drive surface 122. The actuator finger 126 is engaged in the slot 41*a* in the actuator bail arm 41, but the bail arm 42 is disposed in engagement with the resilient spring steel strip 36 which resists pivotal movement of the bail 40 with a predetermined force, and the light frictional engagement of the drive pawl 111 with the outer edge of the actuator plate 120 as the drive plate 110 rotates is insufficient to overcome the urging of the resilient strip 36 to move the dispensing bail 40 and, therefore, the actuator plate 120 remains stationary.

At the completion of the first revolution of the coin wheel 70 in response to insertion of the first coin in the coin receptacle 75, the coin wheel 70 arrives at the position illustrated in FIG. 6, in which the coin receptacle 75 is disposed at the bottom of the dispensing mechanism 50, and the coin falls therefrom into the coin box 35. The coin receptacle 76 is disposed at the top of the dispensing mechanism 50 in position to receive the second coin. Further rotation of the coin wheel 70 is prevented until the second coin is inserted by reason of the operation of the pawls 80 and 82 and the dogs 87 and 89, as was described above.

Upon insertion of the second coin in the coin receptacle 76, and rotation of the coin wheel 70 in a dispensing direction (counterclockwise, as viewed in FIG. 6), the drive plate 110 is rotated with the coin wheel 70, and the drive pawl 111 is pulled in, under the urging of the retaining spring 115, into engagement with the drive surface 122 at the top of the actuator plate 120. Continued rotation of the coin wheel 70, will result in the actuator plate 120 being driven in a counter-clockwise direction through the action of the drive pawl 111, thereby driving the dispensing bail 40 through a dispensing motion from the left-hand position illustrated in broken line in FIG. 6 to a right-hand position for dispensing one of the packages 30, as was described above.

Figure 4:
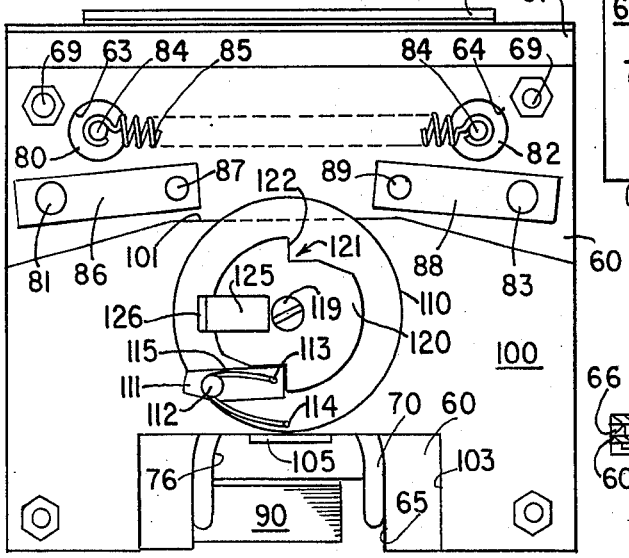
FIG. 4 is a rear elevational view of the dispensing mechanism of the vending machine of FIG. 1, with the parts arranged in the position at the start of a vending operation.

At the completion of the second half revolution of the coin wheel 70 in response to the insertion of the second coin, the coin wheel 70 will have returned to the position of FIG. 4, with the coin receptacle 76 disposed at the bottom of the dispensing mechanism 50 for discharge of the coin therefrom into the coin box 35. The coin receptacle 75 will again be at the top of the dispensing mechanism 50 in position for receipt of another coin in order to undergo the first half revolution of the next dispensing operation. The dispensing bail 40 will be in the position illustrated in solid line in FIG. 3.

It can be seen that the cam flange 105, drive plate 110 and drive pawl 111 cooperate to act as a clutch mechanism movable between an engaged condition (FIG. 4) coupling the coin wheel 70 to the actuator plate 120 and a disengaged condition (FIGS. 5 and 6) decoupling the coin wheel 70 from the actuator plate 120.

It is a significant feature of the present invention, that the structure of the dispensing mechanism 50 readily lends itself to quick and easy modification of a standard single-coin dispensing mechanism. More particularly, if it is desired to convert a single coin dispensing mechanism to the two-coin dispensing mechanism of the present invention, it is necessary only to remove the screw 119 and the old dispensing member, and then remove the bottommost mounting screws 69. Then the cam plate 100, the drive plate 110 and the actuator plate 120 are mounted in place, the screws 69 and 119 are reattached and the retaining spring 115 is set in place. Thus, the conversion can be completed with the simple removal of three screws and can easily be accomplished in a very short time on the vending machine in place.

From the foregoing, it can be seen that there has been provided a novel coin-controlled dispensing mechanism for a vending machine, which enables the machine to perform a dispensing operation only upon the consecutive insertion of two coins of a predetermined denomination in the dispensing mechanism.

There has also been provided a unique dispensing mechanism of the character described, which includes a dispensing member, a coin-receiving means and a clutch mechanism coupled therebetween for disengaging the coin-receiving means from the dispensing member upon the insertion of a first coin, and for engagement of the coin-receiving means with the dispensing means on insertion of a second coin, to enable the dispensing operation.

There has also been provided conversion mechanism for readily converting a single-coin dispensing mechanism to a two-coin dispensing mechanism by a simple on-site modification of the dispensing mechanism.

While there has been described what is at present considered to be the preferred embodiment of the present invention, it will be understood that various modifications may be made therein, and it is intended to cover in the appended claims all such modifications as fall within the true spirit and scope of the invention.

What is claimed is:

1. Coin controlled apparatus comprising coin-enabled means operative upon receipt of a coin therein for undergoing a predetermined movement, actuating means movable for actuating an associated device, and clutch mechanism coupled to said coin-enabled means and movable between an engaged condition coupling said actuating means to said coin-enabled means for movement therewith and a disengaged condition decoupling said actuating means from said coin-enabled means, operation of said coin-enabled means upon receipt of a first coin therein effecting movement of said clutch mechanism to the disengaged condition thereof so that said actuating means is not moved with said coin-enabled means, further operation of said coin-enabled means upon receipt of a second coin therein effecting movement of said clutch mechanism to the engaged condition thereof for moving said actuating means with said coin-enabled means to perform said predetermined function, whereby said predetermined function is performed only after two coins are received in said apparatus.

2. The apparatus set forth in claim 1, wherein said apparatus comprises a vending machine.

3. The apparatus set forth in claim 1, wherein said coin-enabled means includes a coin-receiving wheel rotatable for carrying a coin to a coin discharge station.

4. The apparatus set forth in claim 1, wherein said coin-enabled means and said actuating means are both adapted for rotational movement.

5. In a coin-controlled dispensing mechanism having a dispensing member for dispensing merchandise only upon insertion of two coins, the combination comprising a housing having a coin-receiving slot therein, a coin-receiving wheel mounted for rotation on said housing, a handle connected to said coin-receiving wheel for effecting rotation thereof, means for preventing rotation of said coin-receiving wheel in the absence of a coin therein, an actuating member mounted on said housing and movable for engagement with and actuation of the associated dispensing member, drive means coupled to said coin-receiving wheel for rotation therewith and disposed for driving engagement with said actuating member, bias means urging said drive means toward driving engagement with said actuating member, and a cam member disposed in the path of said drive means for camming engagement therewith to move said drive means out of driving engagement with said actuating member, rotation of said coin-receiving wheel upon receipt of a first coin therein effecting movement of said drive means into camming engagement with said cam member to move said drive means out of driving engagement with said actuating member so that said actuating member is not driven in response to rotation of said coin-receiving wheel, further rotation of said coin-receiving wheel upon receipt of a second coin therein effecting movement of said drive means into driving engagement with said actuating member for driving thereof by said coin-receiving wheel into engagement with the associated dispensing member for actuating same, whereby actuation of the associated dispensing member is effected only upon the receipt of two coins in the coin-receiving wheel.

6. The combination set forth in claim 5, wherein said actuating member includes a disc-like member mounted coaxially with said coin-receiving wheel and having an actuating finger extending therefrom and disposed for engagement with the associated dispensing member.

7. The combination set forth in claim 5, wherein said drive means includes a disc-like drive plate coupled to said coin-receiving wheel, and a drive pawl pivotally mounted on said drive plate for movement with respect thereto between a drive condition in driving engagement with said actuating member and a release condition out of driving engagement with said actuating member.

8. The combination set forth in claim 5, wherein said drive means includes a disc-like drive plate coupled to said coin-receiving wheel, and a drive pawl pivotally mounted on said drive plate for movement with respect thereto between a drive condition in driving engagement with said actuating member and a release condition out of driving engagement with said actuating member, said bias means comprising a leaf spring resiliently urging said drive pawl toward driving engagement with said actuating member.

9. The combination set forth in claim 5, wherein said drive means includes a disc-like drive plate coupled to said coin-receiving wheel, and a drive pawl pivotally mounted on said drive plate for movement with respect thereto between a drive condition in driving engagement with said actuating member and a release condition out of driving engagement with said actuating member, said bias means comprising a leaf spring resiliently urging said drive pawl toward driving engagement with said actuating member, said cam member being disposed adjacent to the periphery of said drive plate for camming engagement with said cam pawl to effect movement thereof out of driving engagement with said actuating member against the urging of said bias means.

10. The combination set forth in claim 5, and further including resilient means disposed for engagement with the associated dispensing member for resisting movement thereof when said drive means is moved out of driving engagement with said actuating member, the driving force of said drive means in engagement with said actuating member after receipt of the second coin overcoming the resistance of said resilient means for actuation of the dispensing member.

11. In a coin-controlled dispensing mechanism having a dispensing member for dispensing merchandise only upon insertion of two coins, the combination comprising a housing having a coin-receiving slot therein, a coin-receiving wheel having two diametrically spaced-apart coin receptacles and mounted on said housing for rotation through a half-revolution upon receipt of a coin therein, a handle connected to said coin-receiving wheel for effecting rotation thereof, means for preventing rotation of said coin-receiving wheel in the absence of a coin in one of said receptacles, an actuating member mounted on said housing for engagement with and actuation of the associated dispensing member and having two equiangularly spaced-apart drive surfaces thereon, drive means coupled to said coin-receiving wheel for rotation therewith and disposed for engagement with said drive surfaces of said actuating member, bias means urging said drive means toward engagement with said drive surfaces of said actuating member, a cam member disposed in the path of said drive means for camming engagement therewith to move said drive means out of engagement with the drive surfaces of said actuating member, rotation of said coin-receiving wheel through a first portion of a first half-revolution upon receipt of a first coin in one of said receptacles effecting movement of said drive means into camming engagement with said cam member to move said drive means out of engagement with one of the drive surfaces of said actuating member so that said actuating member is not driven during movement of said coin-receiving wheel through the remainder of its first half-revolution, rotation of said coin-receiving wheel through a first portion of a second half-revolution upon receipt of a second coin in the other of said receptacles effecting movement of said drive means into engagement with the other drive surface of said actuating member to effect rotation thereof with said coin-receiving wheel through the remainder of the second half-revolution to actuate the associated dispensing member, whereby actuation of the associated dispensing member is effected only upon insertion of two coins in the coin-receiving wheel.

12. The combination set forth in claim 11, wherein said actuating member comprises a disc-like plate mounted concentrically with said coin-receiving wheel and having two perimetrical recesses therein respectively forming said drive surfaces.

13. The combination set forth in claim 11, wherein said actuating member comprises a disc-like plate mounted concentrically with said coin-receiving wheel and having two perimetrical recesses therein respectively forming said drive surfaces, said drive means including a drive plate coupled to said coin-receiving wheel, and a drive pawl pivotally mounted on said drive plate for movement therewith around the perimeter of said actuating plate, said bias means resiliently urging said drive pawl toward engagement with the perimeter of said actuating plate and said drive surfaces formed therein.

14. The combination set forth in claim 11, wherein said coin-receiving wheel is adapted for operation upon receipt of a coin of a single predetermined denomination.

15. In a dispensing apparatus having a dispensing member and actuating means for the dispensing member and a coin-receiving wheel rotatable upon receipt of a single coin therein to move the actuating means into engagement with the dispensing member for actuation of same, conversion mechanism comprising an actuating member adapted to be substituted for the actuating means and disposed for engagement with and actuation of the associated dispensing member, drive means coupled to said coin-receiving wheel for rotation therewith and disposed for driving engagement with said actuating member, bias means urging said drive means toward driving engagement with said actuating member, and a cam member disposed in the path of said drive means for camming engagement therewith to move said drive means out of driving engagement with said actuating member, rotation of said coin-receiving wheel upon receipt of a first coin therein effecting movement of said drive means into camming engagement with said cam member to move said drive means out of driving engagement with said actuating member so that said actuating member is not driven in response to rotation of said coin-receiving wheel, further rotation of said coin-receiving wheel upon receipt of a second coin therein effecting movement of said drive means into driving engagement with said actuating member for driving thereof by said coin-receiving wheel into engagement with the associated dispensing member for actuating same, whereby said dispensing apparatus is converted to a mode of operation wherein actuation of the associated dispensing member is effected only upon the receipt of two coins in the coin-receiving wheel.

* * * * *